US005823272A

United States Patent [19]

van Halteren

[11] Patent Number: 5,823,272

[45] Date of Patent: Oct. 20, 1998

[54] VIBRATING HAMMER, MORE PARTICULARLY FOR DRIVING SHEET PILES INTO THE GROUND

[76] Inventor: Tijmen van Halteren, Dorpsstraat 142, 3751 Et Bunschoten, Netherlands

[21] Appl. No.: 556,505

[22] Filed: Nov. 13, 1995

[30] Foreign Application Priority Data

Nov. 11, 1994 [NL] Netherlands ..... 9401890

[51] Int. Cl.[6] ..... E02D 7/18

[52] U.S. Cl. ..... 173/49; 175/55; 405/249

[58] Field of Search ..... 173/49, 32, 37, 173/132; 175/55, 56; 405/249, 232

[56] References Cited

U.S. PATENT DOCUMENTS

| | | | |
|---|---|---|---|
| 3,100,382 | 8/1963 | Müller | 175/55 |
| 3,101,956 | 8/1963 | Müller | 175/56 |
| 3,224,514 | 12/1965 | Hornstein et al. | 173/49 |
| 3,240,161 | 3/1966 | Belau et al. | 175/55 |
| 3,530,947 | 9/1970 | Gendron | 175/55 |
| 4,018,290 | 4/1977 | Schmidt | 175/55 |
| 5,355,964 | 10/1994 | White | 173/49 |

FOREIGN PATENT DOCUMENTS

| | | | |
|---|---|---|---|
| 2527667 | 12/1983 | France | E02D 13/00 |
| 1634426 | 8/1970 | Germany | E02D 7/18 |
| 6917839 | 5/1970 | Netherlands | E02D 7/18 |

*Primary Examiner*—Scott A. Smith

*Attorney, Agent, or Firm*—Michael D. Bednarek; Kilpatrick Stockton LLP

[57] ABSTRACT

The invention relates to a vibrating hammer, more particularly for driving sheet piles into the ground, the hammer having a lower side with a number of parallel horizontal guide tracks, slide blocks being mounted for adjustment along the tracks, the blocks having each a pair of clamping jaws adapted to grip a sheet pile, the clamping faces of the clamping jaws extending at right angles to the longitudinal direction of the guide tracks. According to the invention, the pairs of clamping jaws take such a position on the sliding blocks engaging the guide tracks that the center lines of the clamping jaws lie laterally offset relative to the longitudinal axis of the respective sliding blocks.

1 Claim, 3 Drawing Sheets

VIBRATING HAMMER, MORE PARTICULARLY FOR DRIVING SHEET PILES INTO THE GROUND

FIELD OF THE INVENTION

The invention relates to a vibrating hammer, more particularly for driving sheet piles into the ground, said hammer having a lower side with a number of parallel horizontal guide tracks, slide blocks being mounted for adjustment along said tracks, said blocks having each a pair of clamping jaws adapted to grip a sheet pile, the clamping faces of said clamping jaws extending at right angles to the longitudinal direction of the guide tracks.

BACKGROUND

Such vibrating hammers are known from FR-A-2527667 and DE-A-1634426 and are used to vibrate a plurality of sheet piles (e.g. two sheet piles in the case of two guide tracks), into the ground simultaneously. In such a case the two piles to be vibrated into the ground simultaneously are beforehand—generally at the factory—coupled to one another by sliding their adjacent longitudinal edges into mutual engagement.

The pair of sheet piles thus coupled has, when viewed from above in the vertical position, a (modified) sine profile that extends through one wavelength. This profile must be clamped between the cooperating clamping jaws of the pairs of clamping jaws at the position of the "crests" (=the centre of the "short parallel sides" of the essentially trapezium-shaped sheet piles).

To this end, the vibrating hammer—suspended from a load carrying hook—is placed in such a position above the vertically positioned pair of piles, that the two guide tracks will become directed at right angles to the "wave direction" of the sine profile. Beforehand the blocks are fixed on or in the guide tracks in such a position that spacing between the two pairs of clamping jaws, as measured in the lengthwise direction of said guide tracks, corresponds to twice the amplitude of the sine profile (=the distance measured crosswise between the "shorter parallel sides" of the two trapezium-shaped sheet piles). In this way the vibrating hammer can be adapted to sheet piles having different profile heights.

Sheet piles, however, may vary in width as well as in profile height (amplitude). Common profile widths are 400, 500 and 600 mm.

This means that the spacing measured in the "wave direction" between the two pairs of clamping jaws, and thus the spacing between the two guide tracks, must be changed in dependence on the width of the sheet piles to be driven into the ground.

To this end it has been the practice to adjust the guide tracks, which are constituted by relatively heavy rails, in the transverse direction. This, however, is a difficult and time-consuming procedure. For, on account of the heavy vibrations to which the fastening of the rails to the lower side of the vibrating hammer is subjected during operation, the rails have to be fixed with many heavy bolts, all of which have to be removed and subsequently refitted and tightened using different holes in the body of the vibrating hammer.

SUMMARY OF THE INVENTION

It is an object of the invention to overcome this drawback of the well-known vibrating hammer.

According to the invention, this aim is achieved in that the pairs of clamping jaws take such a position on the sliding blocks engaging said guide tracks that the centre lines of the clamping jaws lie laterally offset relative to the longitudinal axis of the respective sliding blocks.

As compared with the well-known vibrating hammer, with which the longitudinal axis of each guide track is in the same vertical plane as the centre line of the corresponding pair of clamping jaws, the invention enables the spacing between (the centre lines of) the two pairs of clamping jaws on the two guide tracks to be changed by simply reversing the sliding block in (on) the guide tracks and thereby causing the centre lines of the pairs of clamping jaws to become lying offset towards the opposite side of the longitudinal axis of the respective sliding blocks. This avoids the need for the guide tracks to be removed and refitted. The sliding blocks carrying the pairs of clamping jaws are simply slid off the respective rails, turned back to front and then repositioned onto the rails.

In a practical example of a vibrating hammer with two guide tracks which are 500 mm spaced apart, lateral offsetting of the two pairs of clamping jaws relative to the sliding blocks through an extent of 50 mm leads to the following three sheet pile widths:

500−50−50=400 mm

500+50−50=500 mm and

500+50+50=600 mm

BRIEF DESCRIPTION OF THE DRAWINGS

The invention will be hereinafter explained in greater detail with reference to an exemplary embodiment shown in the drawing, wherein.

DETAILED DESCRIPTION

Figure 1:
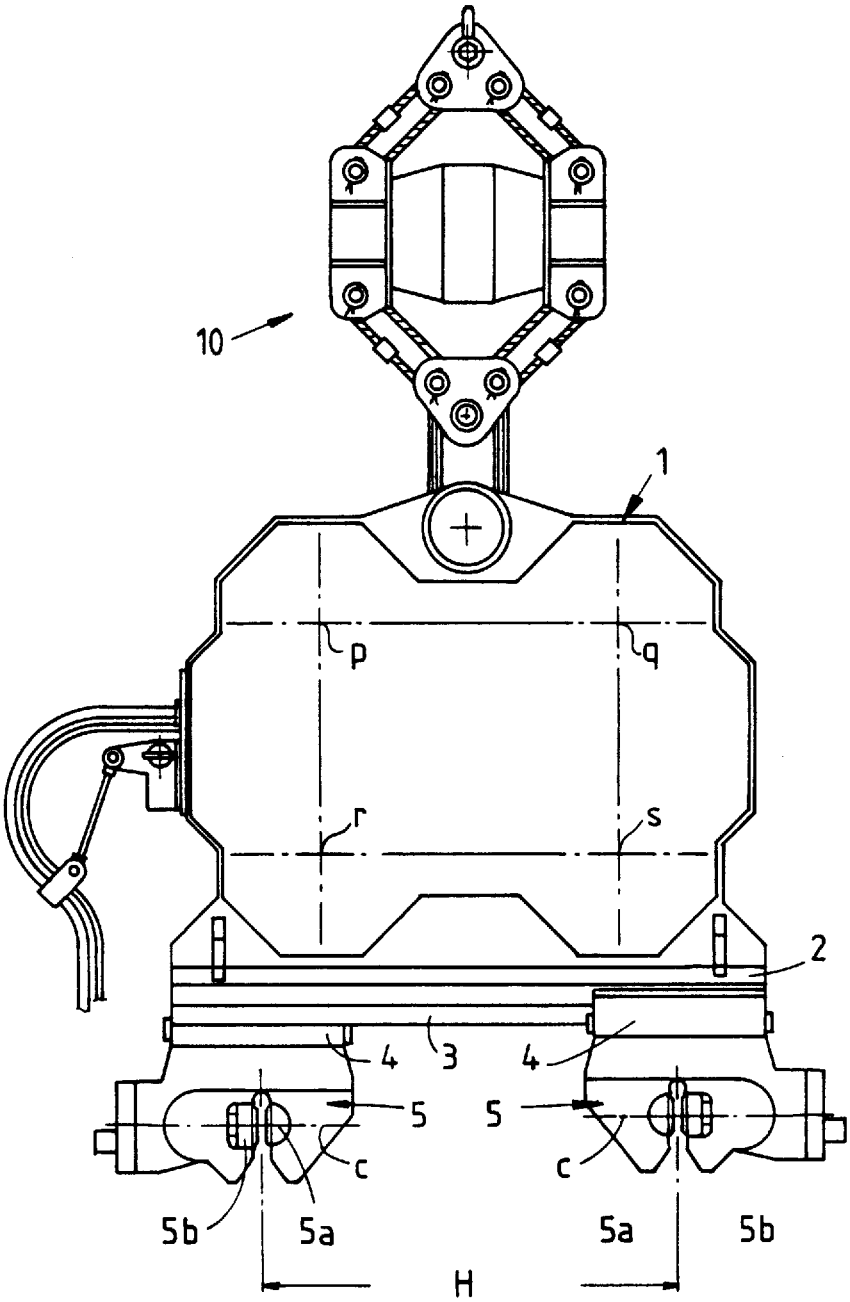
FIG. 1 shows a front view of a vibrating hammer with pairs of clamping jaws according to the invention.

The vibrating hammer shown in the drawing is of a type which is known per se, and comprises a housing of a heavy design, within which vibrating elements (not shown), are mounted for rotation about axes p, q, r and s by a driving motor (neither shown).

Reference number 10 indicates a vibration-damping device, by means of which the housing 1 can be dampingly suspended from the load hook of a crane.

The housing 1 has at its lower side a heavy platen 2, on which two parallel rails 3 are fastened by means of bolts (not shown).

Figure 2:
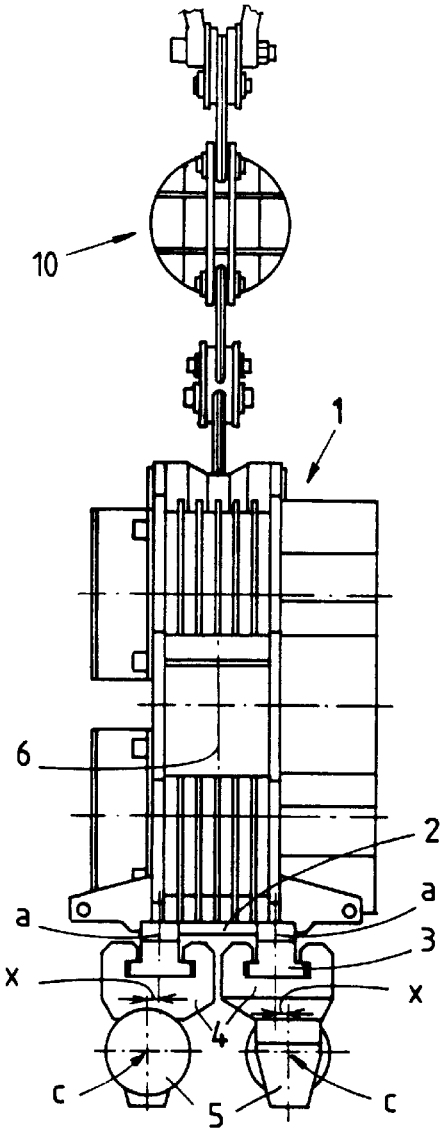
FIG. 2 is a side view of the vibrating hammer according to FIG. 1.

The (vertical) planes of symmetry of the rails 3 are indicated at 'a' in FIG. 2, while the plane of the centre of gravity of the vibrating hammer, parallel thereto and lying midway between them, is indicated at 'b'.

A sliding block 4 is provided on each rail in such a way that it can be slidably adjusted and fixed. Said sliding block is integrally formed with a clamping device 5, that has a fixed clamping jaw 5*a* and a movable (e.g. hydraulically operable) clamping jaw 5*b*. The centre lines through the centre of each pair of interacting clamping jaws 5*a*, 5*b* are indicated at 'c'.

As can be seen in FIG. 2, the clamping devices 5 with the respective pairs of clamping jaws 5*a*, 5*b* have their centre lines 'c' laterally offset through an extent 'x' relative to the planes of symmetry 'a'. In the situation shown in FIG. 2 both pairs of clamping jaws 5*a*, 5*b* are in a laterally outwardly directed offset position, wherein the spacing between the two pairs of clamping jaws is A+2x, when A is the spacing between the rails 3.

As may be easily understood, an interchanging of the two clamping devices 5 will result in a situation in which the pairs of clamping jaws will become positioned offset inwardly due to which the spacing between the two pairs of clamping jaws will be A−2x.

There is yet a third possibility, which arises when in the situation shown in FIG. 2 one of the sliding blocks 4 of the corresponding rail 3 is slid off and, after being turned back to front, is slid back onto the rail. In this situation one pair of clamping jaws is in an outwardly directed offset position, whereas the other pair of clamping jaws is taking an inwardly directed offset position. In this case the spacing between the two pairs of clamping jaws will be A−x+x=A.

Figure 3A:
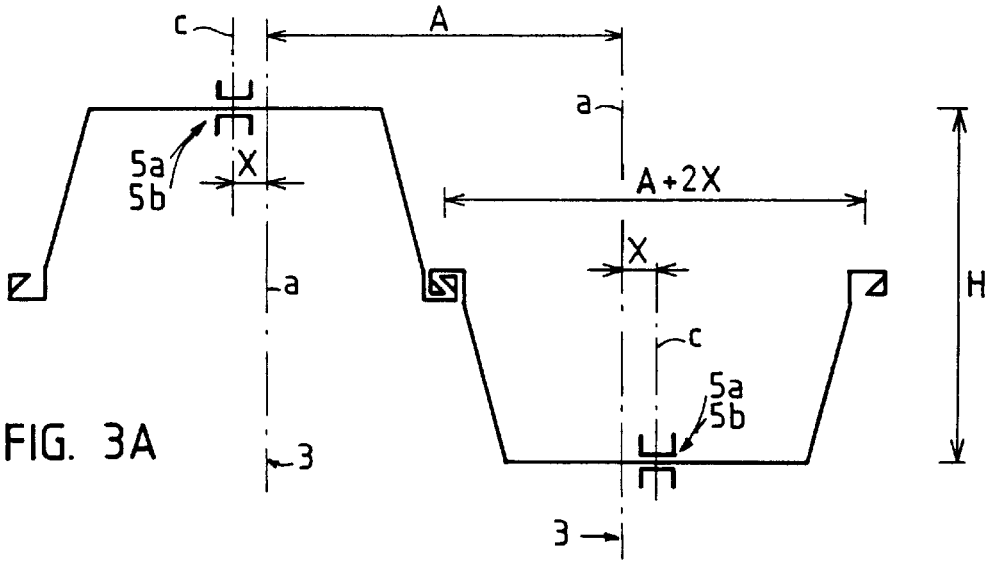
FIGS. 3A, 3B and 3C show diagrammatic plan views of three vertically positioned pairs of sheet piles of different widths, wherein the rails of the same vibrating hammer are indicated by dash-dotted lines, while also showing the positions of the pairs of clamping jaws, adapted to the width of the pairs of sheet piles and gripping the upper edge of the respective pairs of sheet piles
Figure 3B:
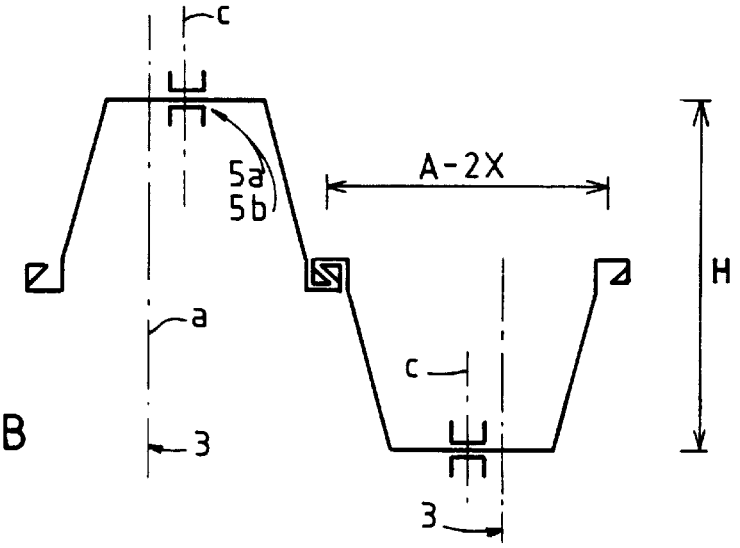
Figure 3C:
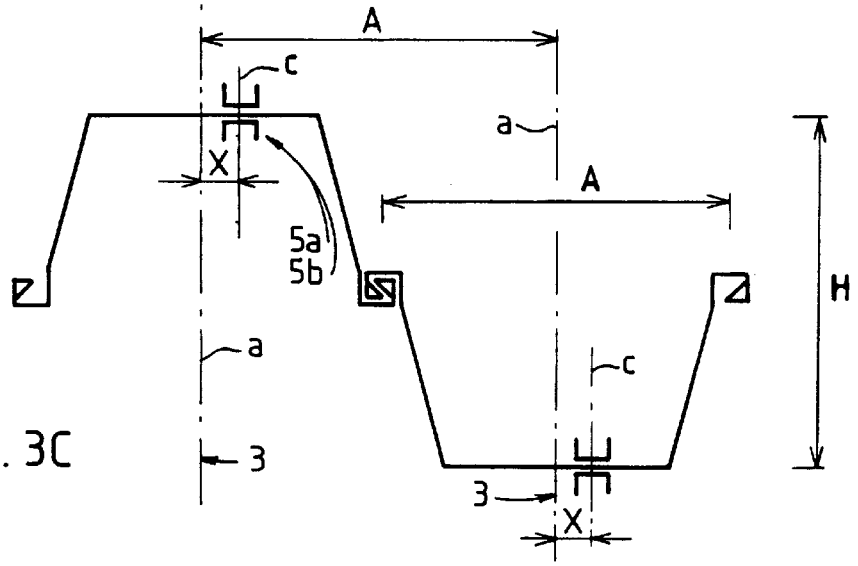

The three possibilities indicated above are shown diagrammatically in FIGS. 3A, 3B and 3C. In this case pairs of sheet piles are involved, the (single) pile widths of which are A+2x; A−2x and A respectively. To drive said pairs of sheet piles into the ground use is made of a vibrating hammer, the rails of which have a fixed spacing A, while the pairs of clamping jaws 5*a*, 5*b* mounted thereon are lying offset to an extent 'x'.

The distance H (=twice the profile height of a single sheet pile) has been selected the same for all three cases and corresponds to the distance H between the rails in FIG. 1, which in practice can generally vary between 700 and 1700 mm.

Figure 4:
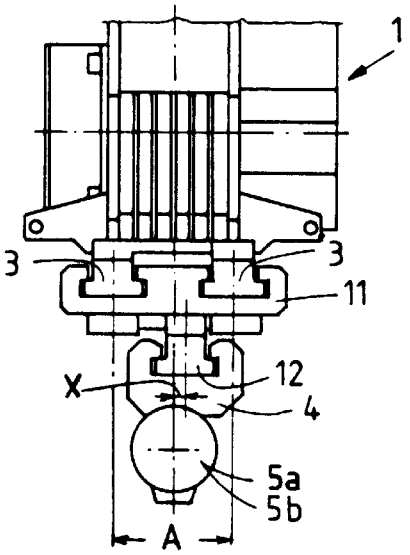
FIG. 4 shows a side view of the bottom part of the vibrating hammer, with a support carrying an auxiliary rail slid onto the rails thereof.

In FIG. 4, in which the bottom part of the vibrating hammer according to FIGS. 1 and 2 is shown, a support 11, provided with complementary grooves, is slid onto the rails 3.

The support 11 may extend over the full length of the rails and carries at its lower side an auxiliary rail 12, having a symmetrical cross-sectional profile that corresponds to that of the rails 3.

Such a support with auxiliary rail is known per se and is used as an auxiliary device when pipes have to be vibrated into the ground by means of the vibrating hammer.

In this case the pairs of clamping jaws have to grip the upper edge of the pipe in diametrically opposite positions, so that they must take mutually aligned positions in the vertical plane of the centre of gravity b (compare FIG. 2).

The support shown in FIG. 4 differs from the well-known embodiment in that the auxiliary rail 12 lies laterally offset relative to the centre plane perpendicular of the support 11 to an extent that corresponds to the extent through which the pairs of clamping jaws lie laterally offset relative to the sliding blocks 4. This also enables to meet the requirement for vibrating pipes with pairs of clamping jaws designed according to the invention.

I claim:

1. A vibrating hammer, for driving sheet piles and the like into the ground, comprising:

a housing having an upper wall, sidewalls and a bottom wall the bottom wall having a lower side;

vibrating means mounted within said housing for rotation about substantially horizontal axes;

suspension means provided on said upper wall;

a pair of guide tracks provided on the lower side of said bottom wall to extend substantially horizontally and parallel to one another, each of said guide tracks having a vertical plane of symmetry;

a pair of slide blocks, placed in sliding engagement with one of said guide tracks and mounted for adjustment along said guide track, each of said slide blocks carrying a pair of clamping jaws with cooperating clamping faces that are mounted for movement relative to one another longitudinally of said guide tracks so as to clamp a sheet pile therebetween, the cooperating clamping faces of each pair of clamping jaws having a common center line extending parallel to said guide tracks and said clamping faces lying in substantially vertical planes at right angles to said guide tracks, wherein the center line of the cooperating clamping faces of each pair of clamping jaws is positioned laterally offset relative to said vertical plane of symmetry of the respective guide track, in such a way that an act of slidingly removing a slide block from the respective guide track, turning said slide block back to front and replacing the slide block onto said guide track will place said slide block in a position which is radially offset relative to said plane of symmetry in an opposite direction.

* * * * *